US009228459B2

(12) United States Patent
Hoglund

(10) Patent No.: US 9,228,459 B2
(45) Date of Patent: Jan. 5, 2016

(54) ACTUATOR FOR AXIAL DISPLACEMENT OF A GAS EXCHANGE VALVE IN A COMBUSTION ENGINE

(71) Applicant: FREEVALVE AB, Angelholm (SE)

(72) Inventor: Anders Hoglund, Munka Ljungby (SE)

(73) Assignee: FREEVALVE AB, Angelholm (SE)

( * ) Notice: Subject to any disclaimer, the term of this patent is extended or adjusted under 35 U.S.C. 154(b) by 0 days.

(21) Appl. No.: 14/408,625

(22) PCT Filed: Jun. 26, 2013

(86) PCT No.: PCT/SE2013/050780

§ 371 (c)(1),
(2) Date: Dec. 17, 2014

(87) PCT Pub. No.: WO2014/007727

PCT Pub. Date: Jan. 9, 2014

(65) Prior Publication Data

US 2015/0184558 A1 Jul. 2, 2015

(30) Foreign Application Priority Data

Jul. 6, 2012 (SE) ..... 1250793

(51) Int. Cl.
*F01L 9/02* (2006.01)
*F01L 25/02* (2006.01)

(52) U.S. Cl.
CPC .. *F01L 9/02* (2013.01); *F01L 9/025* (2013.01); *F01L 25/02* (2013.01)

(58) Field of Classification Search
CPC ..... F01L 9/02; F01L 9/025; F01L 25/02
USPC ..... 123/90.12, 90.13
See application file for complete search history.

(56) References Cited

U.S. PATENT DOCUMENTS 6,502,804 B1 1/2003 Schwegler et al.
7,121,237 B2 10/2006 Hedman (Continued)

FOREIGN PATENT DOCUMENTS

DE 10239750 3/2004
FR 2829178 3/2003
WO 2013/058704 4/2013

OTHER PUBLICATIONS

International Search Report dated Aug. 27, 2013, corresponding to PCT/SE2013/050780.

*Primary Examiner* — Ching Chang
(74) *Attorney, Agent, or Firm* — Young & Thompson

(57) ABSTRACT

An actuator for axially displacing an object includes an actuator piston disc and an actuator piston rod, which together form an actuator piston, a cylinder volume, the actuator piston disc dividing the cylinder volume into a first part and second part and being displaceable in the cylinder volume between an inactive and active position, a pressure fluid circuit arranged for controllable fluid communication with the first part, and a first hydraulic circuit including a liquid-filled space, the actuator piston rod being disposed to be axially displaced in relation to the liquid-filled space in connection with axial displacement of the actuator piston disc in the cylinder volume. The actuator piston includes a second hydraulic circuit, the liquid-filled space being in fluid communication with an inner cavity in the second hydraulic circuit when the actuator piston disc is in the inactive position, the inner cavity partly being delimited by a positioning piston.

7 Claims, 5 Drawing Sheets

(56) References Cited

U.S. PATENT DOCUMENTS 7,305,942 B2 * 12/2007 Chung ..... F01L 9/04 123/90.11
2002/0185091 A1 12/2002 Vorih et al.
2005/0263117 A1 12/2005 Hedman

* cited by examiner

ACTUATOR FOR AXIAL DISPLACEMENT OF A GAS EXCHANGE VALVE IN A COMBUSTION ENGINE

TECHNICAL FIELD OF THE INVENTION

The present invention relates to an actuator for axial displacement of an object. In particular, the present invention relates to a valve actuator for combustion engines, wherein the actuator is suggested to be used for the driving of one or more inlet valves or outlet valves, which control supply and evacuation, respectively, of air in relation to the cylinder of the combustion engine. Hence, the actuator according to the invention is particularly suitable for the driving of engine valves, thereby eliminating the need of one or more camshafts in a combustion engine.

The actuator according to the invention comprises an actuator piston disc, an actuator piston rod that is fixedly connected to and axially projecting from the actuator piston disc and that, together with the actuator piston disc, forms an actuator piston, a cylinder volume, the actuator piston disc dividing said cylinder volume into a first part and a second part and being, in the axial direction, reciprocally displaceable in said cylinder volume between an inactive position and an active position, a pressure fluid circuit arranged for controllable fluid communication with the first part of the cylinder volume, and a first hydraulic circuit comprising a liquid-filled space, the actuator piston rod being disposed to be axially displaced in relation to said liquid-filled space in connection with axial displacement of the actuator piston disc in the cylinder volume.

BACKGROUND OF THE INVENTION AND PRIOR ART

Actuators of the type mentioned by way of introduction are known from, for instance, the applicant's own U.S. Pat. No. 7,121,237. Said document discloses an actuator for the driving of an engine valve, wherein the actuator piston rod of the actuator piston has a hydraulic braking device in the area of the free end thereof, which hydraulic braking device interacts with a mechanical stop in the actuator housing of the actuator. The object of this hydraulic braking device is to reduce the movement speed of the engine valve just before the valve head of the engine valve contacts the valve seat in the cylinder of the combustion engine, and thereby obtain a controlled closing motion, in order to spare the included details and reduce wear and dissonance. Upon closure of the engine valve, the actuator piston rod should contact a mechanical stop in the actuator housing together with the engine valve contacting the seat of the same, in order to obtain correct braking of the engine valve and actuator piston in connection with closure of the engine valve.

It is utmost important that the mutual distance between the hydraulic braking device of the actuator piston rod and the valve head of the engine valve is as large as the mutual distance between the mechanical stop and the seat of the engine valve. The problem of known actuators is that the actuator piston rod does not reach its mechanical stop in the actuator housing, whereupon the retarding effect varies or does not appear at all.

Because the engine valve is exposed to high temperatures during operation, the valve stem of the same will undergo dimensional changes, which directly affects the condition above. In addition, the manufacturing costs will be high if the dimensional tolerances in the production of the included details are narrow, alternatively less narrow dimensional tolerances are used, which entails a need of using shims or the like to adjust the mutual positions of the details. Furthermore, the included details are worn during operation, which further affects the mutual positions of the details.

It should be mentioned that the actuator piston rod, besides the hydraulic braking device, also has other functions where the position of the same in relation to the actuator housing is used for different purposes, for establishing the size of the first part of the cylinder volume, for regulating the fluid communication with the first part of the cylinder volume, etc.

BRIEF DESCRIPTION OF THE OBJECTS OF THE INVENTION

The present invention aims at obviating the above-mentioned disadvantages and failings of previously known actuators and at providing an improved actuator. A primary object of the invention is to provide an improved actuator of the type defined by way of introduction, which guarantees that the actuator piston rod always assumes a well pre-defined inactive position when the actuator is in a rest position.

BRIEF DESCRIPTION OF THE FEATURES OF THE INVENTION

According to the invention, at least the primary object is achieved by means of the actuator that is defined by way of introduction and has the features defined in the independent claim. Preferred embodiments of the present invention are furthermore defined in the depending claims.

According to the present invention, there is provided an actuator of the type defined by way of introduction, which is characterized in that the actuator piston comprises a second hydraulic circuit, the liquid-filled space of the first hydraulic circuit being in fluid communication with an inner cavity in the second hydraulic circuit when the actuator piston disc is in said inactive position, said inner cavity partly being delimited by a positioning piston, which, in the axial direction, is reciprocally displaceable in relation to the actuator piston and which is arranged to abut against said gas exchange valve—which for instance consists of an engine valve—in the second part of the cylinder volume, the second hydraulic circuit comprising a valve that is disposed to prevent fluid flow from the inner cavity, the actuator piston rod having a free end, which is disposed to at least partly abut against a stop surface in the liquid-filled space, when the actuator piston disc is in the inactive position, the pressurized area of the positioning piston, which faces the inner cavity, being as large as or smaller than the pressurized area of the free end of the actuator piston rod.

Accordingly, the present invention is based on the understanding that, by means of a movable positioning piston in relation to the actuator piston, it can be guaranteed that the actuator piston rod always assumes a pre-defined inactive position when the engine valve is closed and the actuator inactive.

In a further preferred embodiment, the actuator piston rod has, in the area of the free end of the same, a hydraulic braking device, which is arranged to reduce the movement speed of the actuator piston before the free end of the actuator piston rod contacts said stop surface.

Further advantages and features of the invention are seen in the other dependent claims as well as in the following, detailed description of preferred embodiments.

BRIEF DESCRIPTION OF THE DRAWINGS

A more complete understanding of the above-mentioned and other features and advantages of the present invention will be evident from the following, detailed description of preferred embodiments, reference being made to the accompanying drawings, wherein.

DETAILED DESCRIPTION OF PREFERRED EMBODIMENTS

The present invention relates to an actuator, generally designated 1, for axial displacement of an object. With an exemplifying but not limiting purpose, the invention will hereinbelow be described with reference to an application in which the actuator 1 is utilized for the driving of one or more gas exchange valves, such as inlet valves or outlet valves, in the cylinder of a combustion engine.

Figure 1:
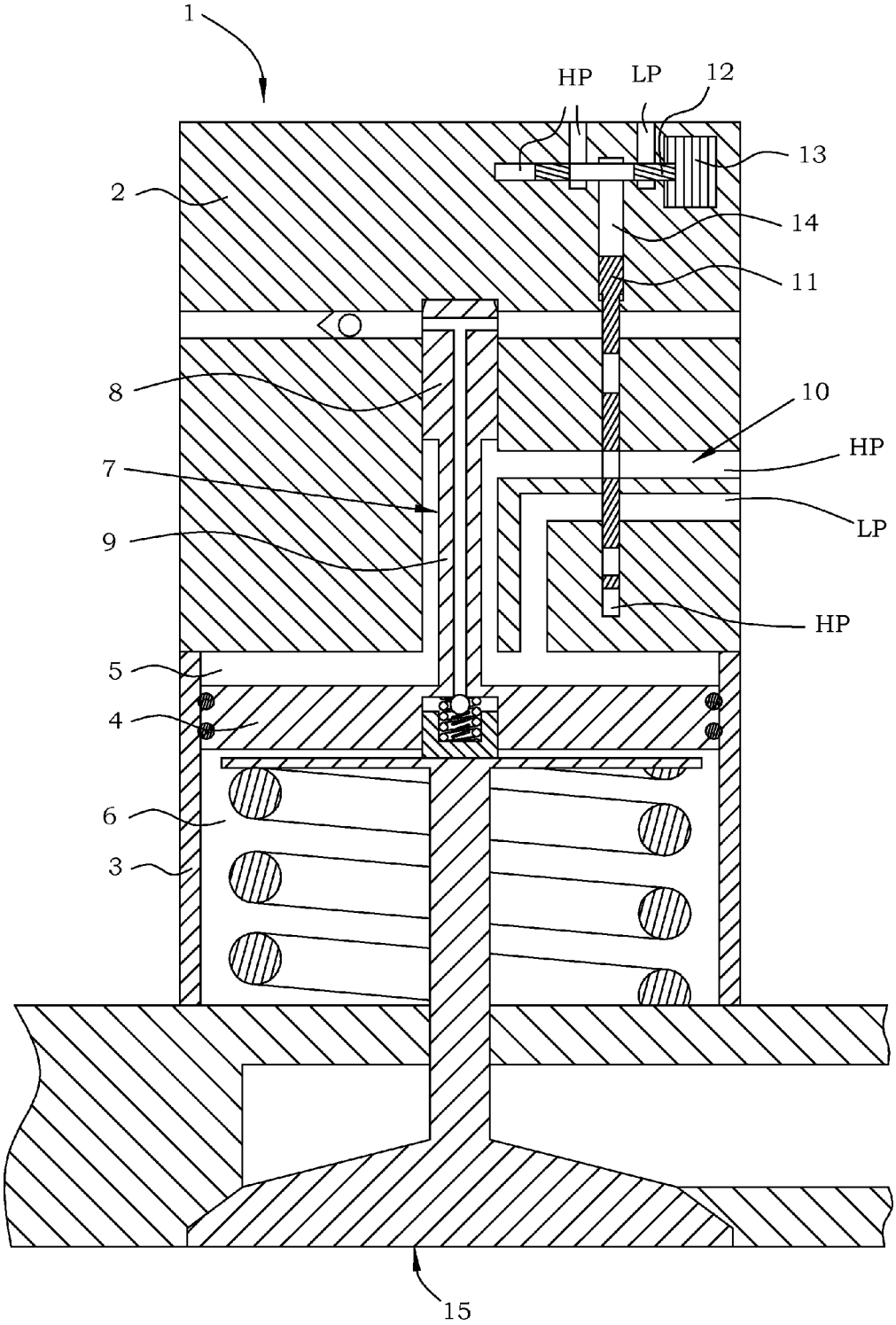
FIG. 1 is a schematic, cut-away side view of an actuator according to a first embodiment, the actuator piston being situated in an inactive position.
Figure 2:
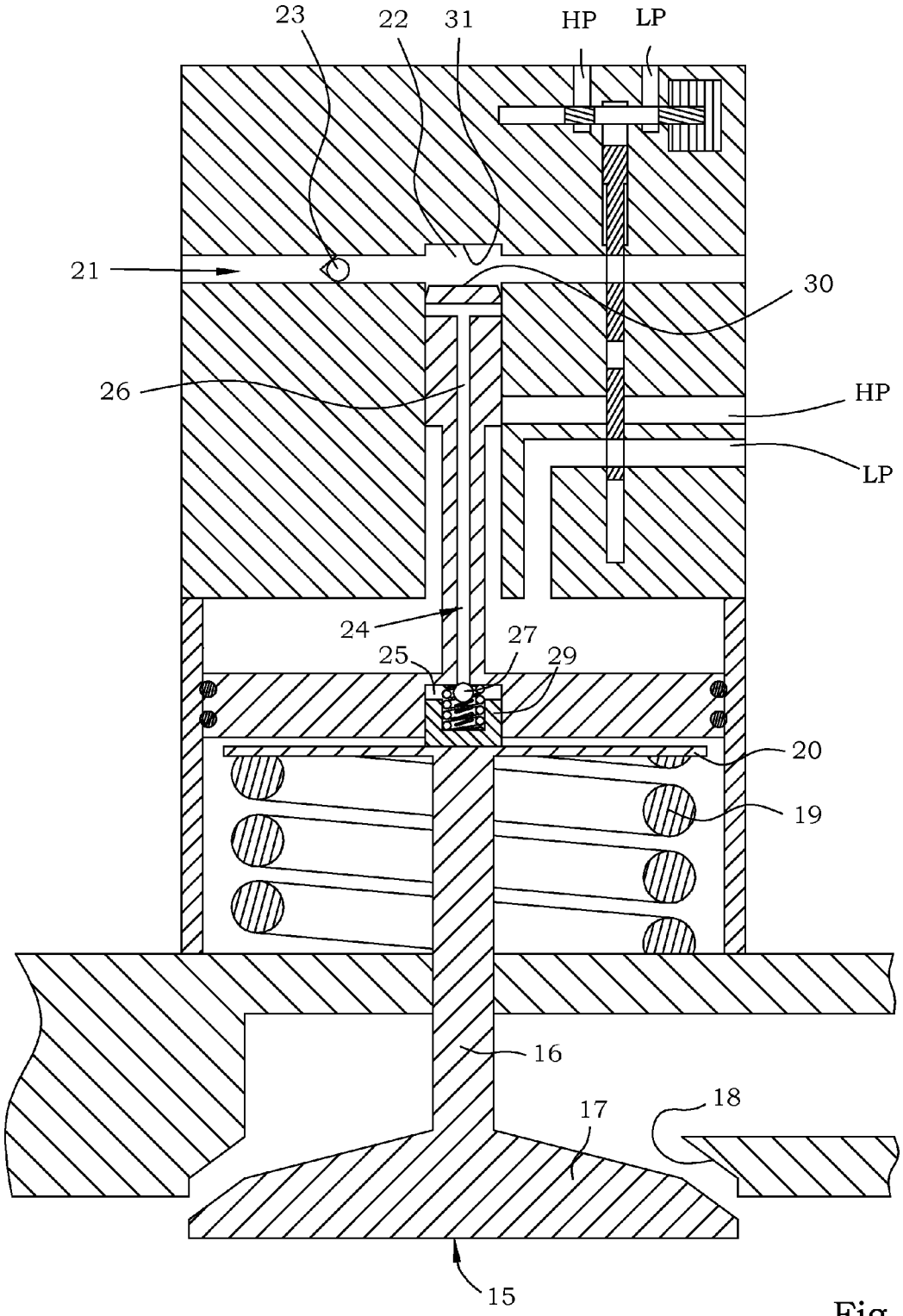
FIG. 2 is a schematic, cut-away side view of the actuator shown in FIG. 1 showing the actuator piston in an active position.

Reference is initially made to FIGS. 1 and 2, which show a first embodiment of the actuator 1 according to the invention. The actuator 1 comprises an actuator housing 2, a cylinder 3 delimiting a cylinder volume or chamber, an actuator piston disc 4 that, in the axial direction, is reciprocally displaceable in said cylinder volume between an inactive position (FIG. 1) and an active position (FIG. 2). The actuator piston disc 4 divides said cylinder volume into a first, upper part 5 and a second, lower part 6.

Furthermore, the actuator 1 comprises an actuator piston rod, generally designated 7, which is fixedly connected to and axially projecting from the actuator piston disc 4, and which, together with the actuator piston disc, forms an actuator piston. In the embodiment shown, the actuator piston rod 7 has a first, thicker portion 8, which is situated at a distance from the actuator piston disc 4 and which closes tightly against a bore in the actuator housing 2, and a second, thinner portion 9, which extends between and connects the thicker portion 8 and the actuator piston disc 4.

The actuator 1 also comprises a pressure fluid circuit, generally designated 10, arranged for controllable supply of a gas or gas mixture to the first part 5 of the cylinder volume for starting a pressure pulse, and arranged for controllable evacuation of the gas or the gas mixture from the first part 5 of the cylinder volume for the termination of said pressure pulse.

The pressure fluid circuit 10 is connected to a pressure fluid source (HP) and a pressure fluid sink (LP). The pressure fluid source may be a compressor belonging to the engine with an appurtenant tank or simply a pressure tank. The pressure fluid sink may be any point with lower pressure than the one that is generated in the pressure fluid source, for example the atmosphere, or a conduit that leads back to the compressor.

In the embodiment shown, the actuator 1 comprises a directly or indirectly electrically controlled first valve body 11, which first valve body 11 is disposed in the pressure fluid circuit 10 for the control of the pressure fluid flow in the pressure fluid circuit 10. With electrically controlled, controlled by means of an electromagnetic device, by means of a piezo-electric device, etc., is meant. In a preferred embodiment, the actuator 1 further comprises a so-called pilot valve 12 in the form of a three-way valve, which pilot valve 12 is disposed to be driven by an electromagnet 13. The pilot valve may also be a piezo-electric valve, or another similar electrically controlled valve. The pilot valve 12 is disposed to alternately open to an activation duct 14 for fluid communication with the pressure fluid source (HP) and the pressure fluid sink (LP), respectively. Furthermore, the upper end of the first valve body 11 is disposed in the activation duct 14, on which the pressure fluid flow from the pressure fluid source can act against and displace the first valve body 11 downward. The pilot valve 12 is preferably biased in a first direction (toward the right) by means of a gas spring, mechanical spring or the like, whereupon an activation of the electromagnet 13 gets the pilot valve 12 to be displaced in a second direction (toward the left), and when the electromagnet 13 is shut off, the pilot valve 12 returns by being displaced in the other direction (toward the right). In the figures, it is thus shown that the first valve body 11 is indirectly electrically controlled. In case the electromagnet 13 acts directly on the first valve body 11, the first valve body 11 is directly electrically controlled, i.e., in this embodiment, the pilot valve and the activation duct are lacking.

When the pilot valve 12 opens for pressure fluid flow from the pressure fluid source to the activation duct 14, the first valve body 11 is brought to be displaced to a lower position, shown in FIG. 1. The first valve body 11 is thus brought to open for pressure fluid flow in the pressure fluid circuit from the pressure fluid source, with which the pressure fluid circuit 10 is connected, to the first part 5 of the cylinder volume. A pulse of pressure fluid will then act against and displace the actuator piston disc 4 in the cylinder volume from the position shown in FIG. 1 to and past the position shown in FIG. 2. FIG. 1 thus shows an instantaneous picture when the first valve body 10 has been displaced but the actuator piston disc 4 still has not begun to move. In FIG. 1, the actuator piston thus remains in its inactive position, and will thereafter initiate its movement downward to generate a pressure pulse.

In FIG. 2, the actuator piston disc 4 in the active position of the same is shown, and the thicker portion 8 of the actuator piston rod 7 has closed the pressure fluid circuit 10 to prevent continued inflow of pressure fluid from the pressure fluid source to the first part 5 of the cylinder volume. In FIG. 2, there is also shown that the pilot valve 12 has been displaced in the other direction (toward the right) to allow fluid communication between the pressure fluid sink and the activation duct 14, and thereby the first valve body 11 being biased in the upward direction has, by means of a gas spring, a mechanical spring, or the like, been displaced to the upper position, for the evacuation of the gas in the first part 5 of the cylinder volume in order to allow return movement of the actuator piston disc 4 from the active position of the same to the inactive position of the same. When evacuation occurs, the actuator piston disc 4 thus returns to the inactive position shown in FIG. 1.

In the embodiments shown, the actuator 1 interacts with an engine valve, generally designated 15, which has a valve stem 16 and a valve head 17. The valve stem 16 extends through a stationary part of the combustion engine and into the cylinder 3 of the actuator 1, and more precisely into the second part 6 of the cylinder volume, and the valve head 17 is disposed to interact with a valve seat 18 for alternately permitting and preventing, respectively, passage of gas/air to the cylinder of the combustion engine. The engine valve 15 is displaceable in the axial direction by means of the actuator 1, by the actuator piston disc 4 of the actuator 1 acting indirectly on an upper end of the valve stem 16 of the valve 15 to displace the valve 15 from the closed position of the same (FIG. 1) to the open position of the same (FIG. 2). Furthermore, the combustion engine preferably comprises a conventional, schematically shown, valve spring 19, which is arranged to bring back the valve 15 from the open position thereof to the closed position thereof. The valve spring 19 acts in the lower end thereof directly or indirectly against the stationary part of the combustion engine, and in the upper end thereof against a carrier 20, or valve spring retainer, which is connected to the valve stem 16 in the area of the upper end thereof.

The actuator 1 also comprises a first hydraulic circuit, generally designated 21, comprising a liquid-filled space 22, the actuator piston rod 7 being disposed to be axially displaced in relation to said liquid-filled space 22 in connection with axial displacement of the actuator piston disc 4 in the cylinder volume. Liquid can flow into the liquid-filled space 22 via a non-return valve 23 and out of the liquid-filled space 22 via a controllable valve, which, in the embodiment shown, is the first valve 11. When the actuator piston is displaced from the inactive position (FIG. 1) to the active position (FIG. 2), the actuator piston rod 7 leaves room for inflow of liquid into the liquid-filled space 22, and when the actuator piston is displaced from the active position to the inactive position, liquid is pressed out of the liquid-filled space 22.

Figure 3:
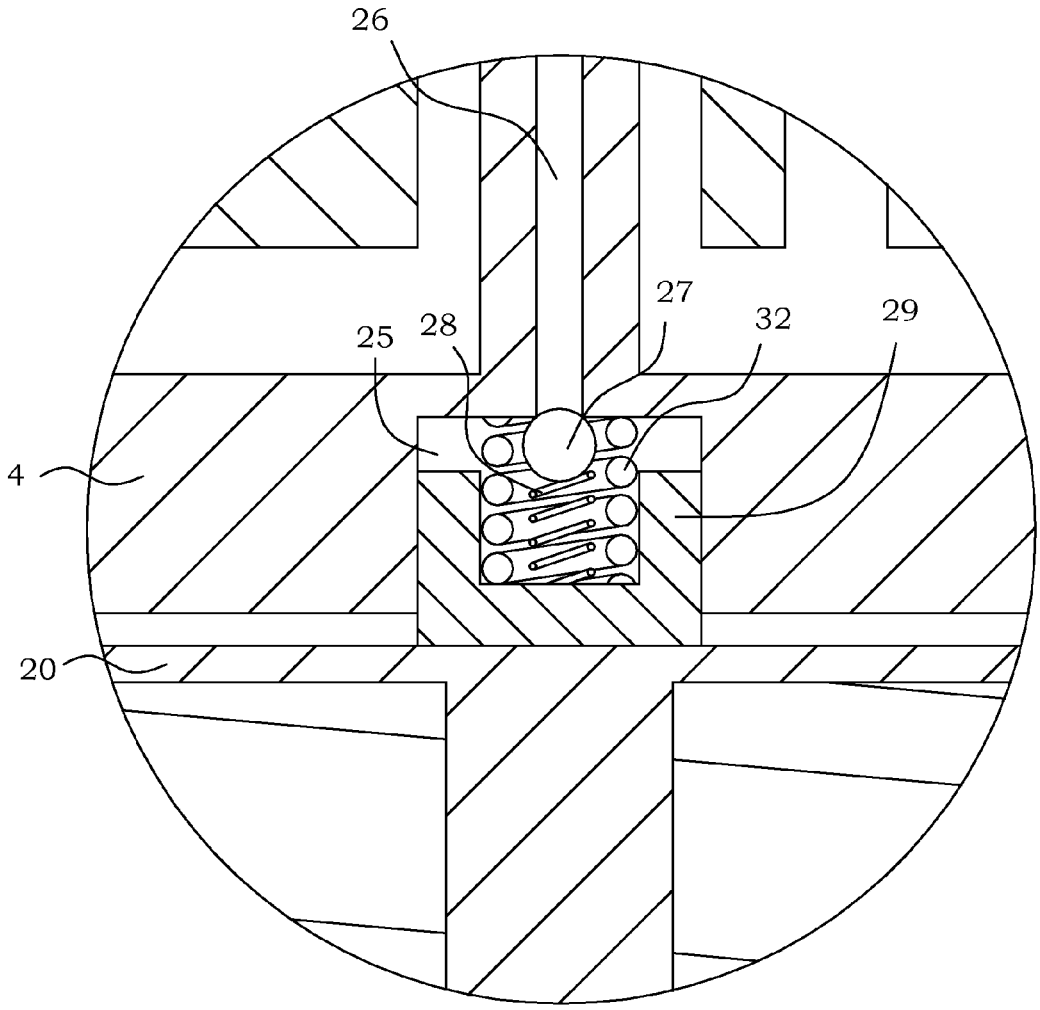
FIG. 3 is an enlargement of a part of the actuator according to the FIGS. 1 and 2, showing the inner cavity of the second hydraulic circuit.

Reference is now also made to FIG. 3, which in enlargement shows a part of the actuator according to the embodiment shown in FIGS. 1 and 2. According to the actuator 1 according to the invention, the actuator piston comprises a second hydraulic circuit, generally designated 24, which in turn comprises an inner cavity 25. When the actuator piston disc 4 is in said inactive position, the liquid-filled space 22 of the first hydraulic circuit 21 is in fluid communication with the inner cavity 25 in the second hydraulic circuit 24. An internal channel 26 mouths in a first end in the inner cavity 25 and in a second end in an envelope surface of the thicker portion 8 of the actuator piston rod 7. The second end of the internal channel 26 should thus be arranged in fluid communication with the liquid-filled space 22 when the actuator piston disc 4 is in the inactive position, and furthermore said fluid communication should preferably be broken when the actuator piston disc 4 is in the active position. The second hydraulic circuit 24 comprises further a valve 27 that is disposed to prevent fluid flow from the inner cavity 25 to the liquid-filled space 22. Preferably, said valve 27 is a non-return valve, which is held in a position sealing the internal channel 26 by means of a non-return valve spring 28.

The inner cavity 25 is partly delimited by a positioning piston 29, which, in the axial direction, is reciprocally displaceable in relation to the actuator piston and which is arranged to act on the engine valve 15 in the second part 6 of the cylinder volume. The liquid present in the inner cavity 25 is allowed to, to a small extent, leak past the positioning piston 29 into the second part 6 of the cylinder volume.

The actuator piston rod 7 has a free end 30, which is disposed to at least partly abut against a stop surface 31 in the liquid-filled space 22, when the actuator piston disc 4 is in the inactive position. In the embodiment according to FIGS. 1-3, the positioning piston 29 is biased in the direction into the second part 6 of the cylinder volume by means of a spring 32 disposed in the inner cavity 25. When the valve head 17 of the engine valve 15 reaches the seat 18 of the same and the free end 30 of the actuator piston rod 7 does not abut against said stop surface 31, the positioning piston 29 will abut against the engine valve 15 and the spring 32 will press the actuator piston axially upward until the free end 30 of the actuator piston rod 7 abuts against the stop surface 31, while liquid is pressed in and retained in the inner cavity 25. Accordingly, the function of the positioning piston 29 is to position the actuator piston in the correct situation each time the actuator piston disc 4 is in the inactive position.

The positioning piston 29 has a pressurized area, i.e., an area that consists of the axially projected area of the positioning piston, against which the liquid in the inner cavity 25 acts to prevent the positioning piston 29 from being pressed into the inner cavity 25. In the embodiment according to FIGS. 1-3, the pressurized area of the positioning piston 25, which faces the inner cavity 25, is as large as or smaller than the pressurized area of the free end 30 of the actuator piston rod 7.

In the embodiments shown of the actuator 1 according to the invention, the actuator piston rod 7 has, in the area of the free end of the same, a hydraulic braking device, which is arranged to reduce the movement speed of the actuator piston before the free end 30 of the actuator piston rod 7 contacts said stop surface 31, and is thereby arranged to reduce the movement speed of the engine valve 15 before the engine valve 15 contacts the seat 18 of the same. The hydraulic braking device consists of a geometrical constriction between the actuator piston rod 7 and the liquid-filled space 22, which geometrical constriction decreases as the free end 30 of the actuator piston rod 7 approaches said stop surface 31, whereby the braking force increases.

Figure 4:
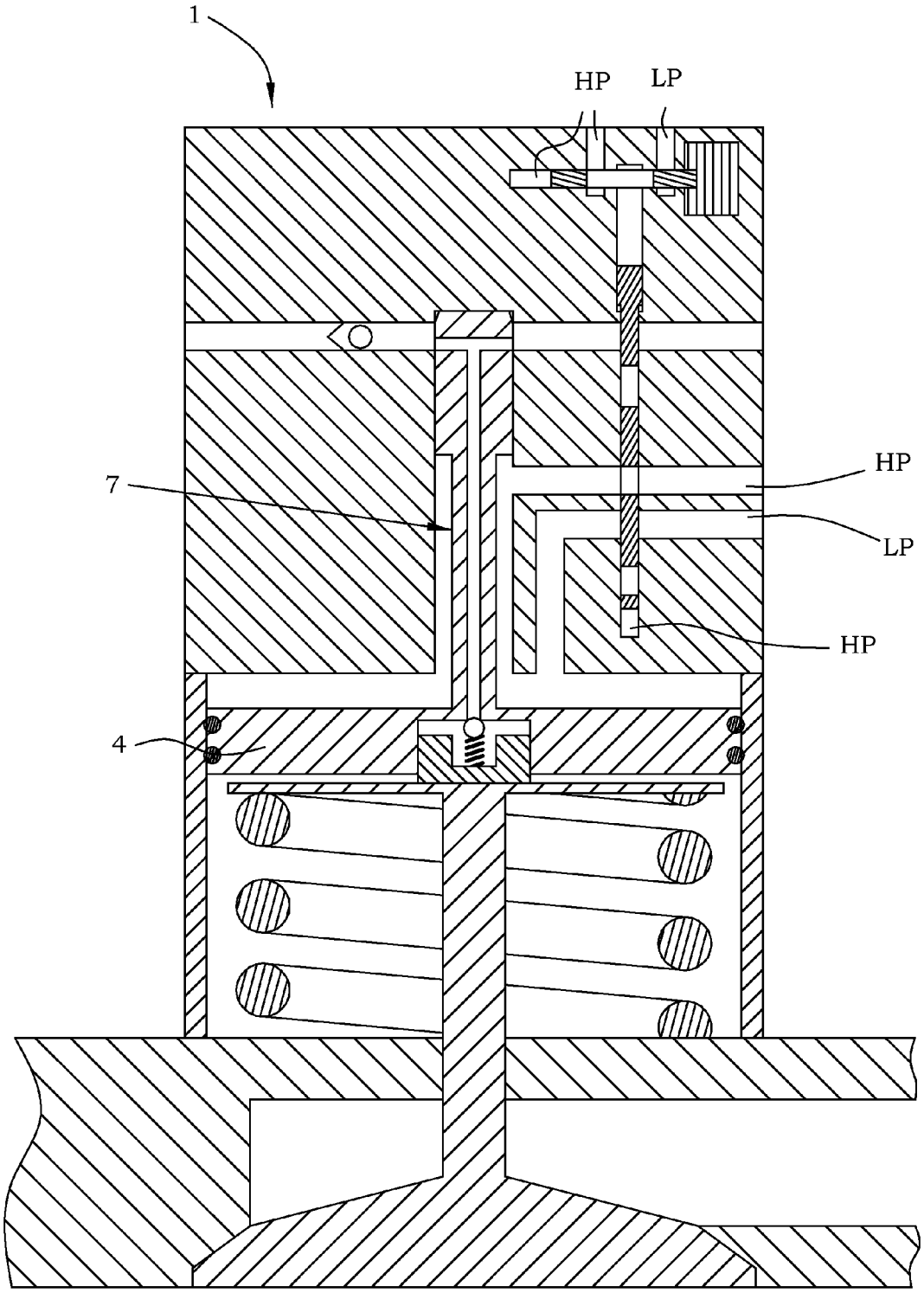
FIG. 4 is a schematic, cut-away side view of an actuator according to a second embodiment, the actuator piston being situated in an inactive position.
Figure 5:
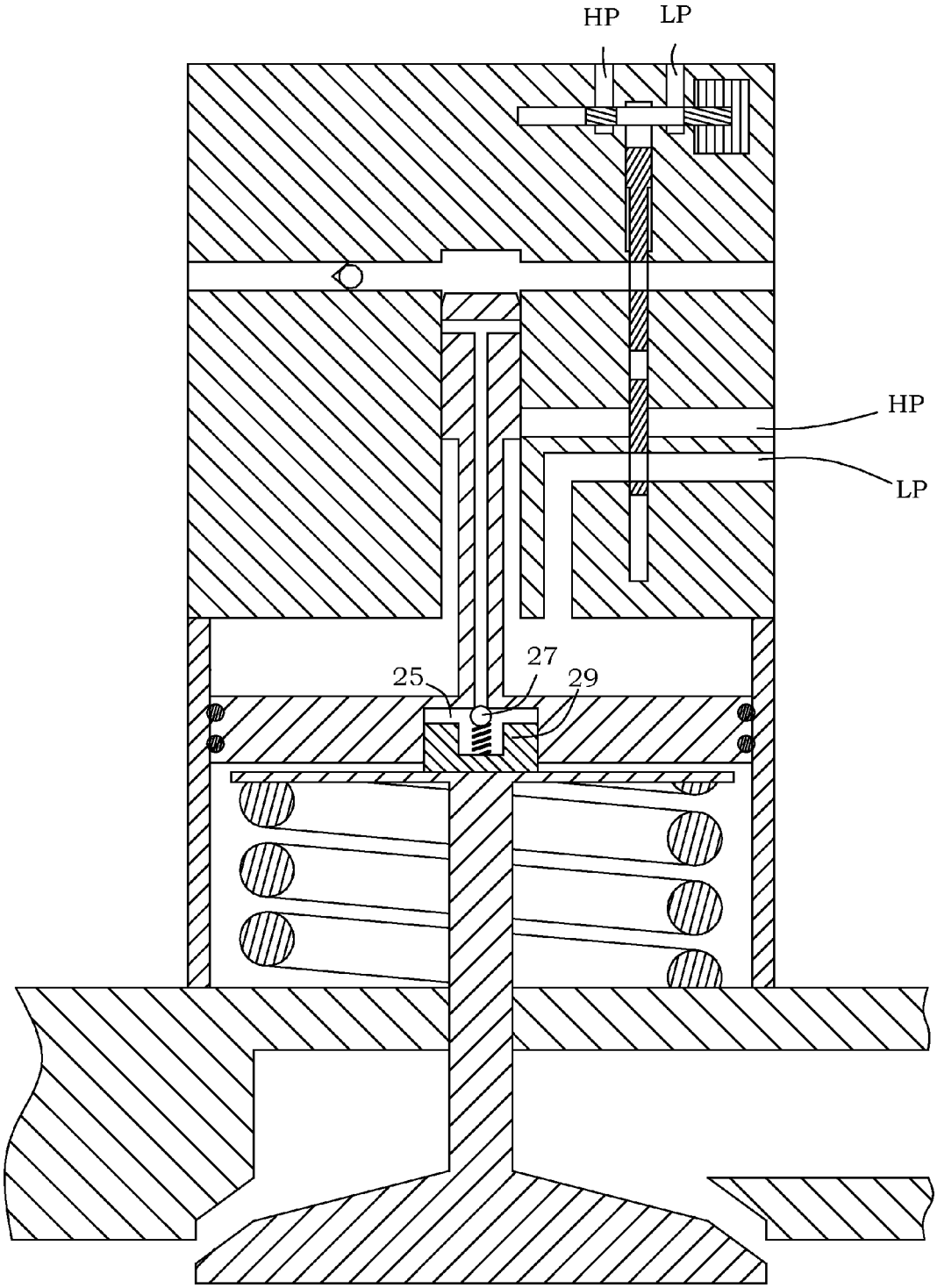
FIG. 5 is a schematic, cut-away side view of the actuator shown in FIG. 4 showing the actuator piston in an active position.

Reference is now made to FIGS. 4 and 5, which show the actuator 1 according to a second embodiment. Only differences in relation to the first embodiment will be described. In this second embodiment, the pressurized area of the positioning piston 29, which faces the inner cavity 25, is greater than the pressurized area of the free end 31 of the actuator piston rod 7. Simultaneously, there is no need of a spring that presses apart the positioning piston 29 and the actuator piston, as is required in the embodiment according to FIGS. 1-3. However, the location of the second end of the inner channel 26 that mouths in the envelope surface of the thicker portion 8 of the actuator piston rod 7 is utmost important. The second end of the internal channel 26 should be arranged in fluid communication with the liquid-filled space 22 when the actuator piston disc 4 is in the inactive position, and furthermore said fluid communication should be broken immediately after the actuator piston disc 4 has left the inactive position. If the internal channel 26 is not broken when the actuator piston disc 4 is in the active position, the actuator piston will be pressed upward and thereby prevent the engine valve 15 from closing correctly.

Feasible Modifications of the Invention

The invention is not limited only to the embodiments described above and shown in the drawings, which only have illustrating and exemplifying purpose. This patent application is intended to cover all adaptations and variants of the preferred embodiments described herein, and consequently the present invention is defined by the wording of the accompanying claims and the equipment may accordingly be modified in all feasible ways within the scope of the accompanying claims.

It should also be pointed out that all information about/regarding terms such as above, below, upper, under, etc., should be interpreted/read with the equipment orientated in accordance with the figures, with the drawings orientated in such a way that the reference designations can be read in a proper way. Accordingly, such terms only indicate mutual relationships in the shown embodiments, which relationships may be changed if the equipment according to the invention is provided with another construction/design.

It should be pointed out that even if it is not explicitly mentioned that features from one specific embodiment can be combined with the features of another embodiment, this should be regarded as evident when possible.

The invention claimed is:

1. An actuator for axial displacement of a gas exchange valve in a combustion engine, the actuator comprises an actuator piston disc (4), an actuator piston rod (7), which is fixedly connected to and axially projecting from the actuator piston disc (4), and which, together with the actuator piston disc, forms an actuator piston, a cylinder volume, the actuator piston disc (4) dividing said cylinder volume into a first part (5) and a second part (6) and being, in the axial direction, reciprocally displaceable in said cylinder volume between an inactive position and an active position, a pressure fluid circuit (10) arranged for controllable fluid communication with the first part (5) of the cylinder volume, and a first hydraulic circuit (21) comprising a liquid-filled space (22), the actuator piston rod (7) being disposed to be axially displaced in relation to said liquid-filled space (22) in connection with axial displacement of the actuator piston disc (4) in the cylinder volume, characterized in that the actuator piston comprises a second hydraulic circuit (24), the liquid-filled space (22) of the first hydraulic circuit (21) being in fluid communication with an inner cavity (25) in the second hydraulic circuit (24) when the actuator piston disc (4) is in said inactive position, said inner cavity (25) partly being delimited by a positioning piston (29), which, in the axial direction, is reciprocally displaceable in relation to the actuator piston and which is arranged to press on said gas exchange valve in the second part (6) of the cylinder volume, the second hydraulic circuit (24) comprising a valve (27) that is disposed to prevent fluid flow from the inner cavity (25), the actuator piston rod (7) having a free end (30), which is disposed to at least partly abut against a stop surface (31) in the liquid-filled space (22), when the actuator piston disc (4) is in the inactive position, a pressurized area of the positioning piston (29), which faces the inner cavity (25), being as large as or smaller than a pressurized area of the free end (30) of the actuator piston rod (7).

2. The actuator according to claim 1, wherein the valve (27) of said second hydraulic circuit (24) is a non-return valve.

3. The actuator according to claim 2, wherein the positioning piston (29) is biased in the direction into the second part (6) of the cylinder volume by means of a spring (32).

4. The actuator according to claim 2, wherein the actuator piston rod (7), in the area of the free end (30) of the actuator piston rod, has a hydraulic braking device, which is arranged to reduce the movement speed of the actuator piston before the free end (30) of the actuator piston rod (7) contacts said stop surface (31).

5. The actuator according to claim 1, wherein the positioning piston (29) is biased in the direction into the second part (6) of the cylinder volume by means of a spring (32).

6. The actuator according to claim 5, wherein the actuator piston rod (7), in the area of the free end (30) of the actuator piston rod, has a hydraulic braking device, which is arranged to reduce the movement speed of the actuator piston before the free end (30) of the actuator piston rod (7) contacts said stop surface (31).

7. The actuator according to claim 1, wherein the actuator piston rod (7), in the area of the free end (30) of the actuator piston rod, has a hydraulic braking device, which is arranged to reduce the movement speed of the actuator piston before the free end (30) of the actuator piston rod (7) contacts said stop surface (31).

* * * * *